US011325272B2

(12) United States Patent
Tucker et al.

(10) Patent No.: US 11,325,272 B2
(45) Date of Patent: May 10, 2022

(54) SHAVING SYSTEMS

(71) Applicant: SHAVELOGIC, INC., Dallas, TX (US)

(72) Inventors: William E. Tucker, Attleboro, MA (US); Dougals R. Kohring, Arrowsic, ME (US)

(73) Assignee: SL IP COMPANY LLC, Dallas, TX (US)

( * ) Notice: Subject to any disclaimer, the term of this patent is extended or adjusted under 35 U.S.C. 154(b) by 219 days.

(21) Appl. No.: 16/632,125

(22) PCT Filed: Jun. 26, 2018

(86) PCT No.: PCT/US2018/039426
§ 371 (c)(1),
(2) Date: Jan. 17, 2020

(87) PCT Pub. No.: WO2019/018104
PCT Pub. Date: Jan. 24, 2019

(65) Prior Publication Data

US 2020/0223081 A1 Jul. 16, 2020

Related U.S. Application Data

(60) Provisional application No. 62/535,006, filed on Jul. 20, 2017.

(51) Int. Cl.
*B26B 21/52* (2006.01)
*B26B 21/22* (2006.01)

(52) U.S. Cl.
CPC ..... *B26B 21/521* (2013.01); *B26B 21/225* (2013.01)

(58) Field of Classification Search
None
See application file for complete search history.

(56) References Cited

U.S. PATENT DOCUMENTS 4,428,116 A 1/1984 Chen et al.
5,038,472 A * 8/1991 Iderosa ..... B26B 21/521 30/527
5,402,574 A * 4/1995 Milner ..... B26B 21/227 30/41.5
5,560,106 A * 10/1996 Armbruster ..... B26B 21/225 30/526
5,678,316 A * 10/1997 Althaus ..... B26B 21/522 30/340

(Continued)

FOREIGN PATENT DOCUMENTS

EP 1531030 A2 5/2005
EP 2123410 A1 11/2009

OTHER PUBLICATIONS

International Application No. PCT/US2018/039426 International Search Report and Written Opinion dated Aug. 29, 2018.

(Continued)

*Primary Examiner* — Hwei-Siu C Payer
(74) *Attorney, Agent, or Firm* — Leber IP Law; Celia H. Leber

(57) ABSTRACT

Shaving razors and shaving assemblies for wet shaving are disclosed, which include a blade unit pivotably mounted on arms extending from an interface element. The arms have features that allow them to flex, in some cases in a differential manner depending on the direction of applied forces.

28 Claims, 29 Drawing Sheets

(56) References Cited

U.S. PATENT DOCUMENTS

| | | | | |
|---|---|---|---|---|
| 6,311,400 | B1 | 11/2001 | Hawes et al. | |
| 6,598,303 | B2 * | 7/2003 | Bosy | B26B 21/225 30/50 |
| 7,152,512 | B1 | 12/2006 | Prochaska | |
| 8,033,023 | B2 * | 10/2011 | Johnson | B26B 21/225 30/50 |
| 8,789,282 | B2 | 7/2014 | Wilson et al. | |
| 9,283,685 | B2 | 3/2016 | Griffin et al. | |
| 9,486,930 | B2 * | 11/2016 | Provost | B26B 21/14 |
| 9,623,575 | B2 | 4/2017 | Griffin et al. | |
| 2010/0281698 | A1 | 11/2010 | King | |
| 2013/0081276 | A1 | 4/2013 | Wain et al. | |
| 2015/0190936 | A1 * | 7/2015 | Griffin | B26B 21/521 132/200 |
| 2020/0223080 | A1 * | 7/2020 | Tucker | B26B 21/521 |
| 2020/0223081 | A1 * | 7/2020 | Tucker | B26B 21/225 |

OTHER PUBLICATIONS

European Patent Application No. 18835434.4 Extended European Search Report dated Mar. 9, 2021, 7 pages.

* cited by examiner

SHAVING SYSTEMS

RELATED APPLICATIONS

This application is a national phase entry of International Patent Application No. PCT/US2018/39426, filed Jun. 26, 2018, which claims priority from U.S. Patent Application Ser. No. 62/535,006, filed Jul. 20, 2017, the entire disclosures of which are incorporated herein by reference.

BACKGROUND

The invention relates to shaving razors for wet shaving, having handles and replaceable blade units in which one or more blades are mounted in a plastic housing. After the blades in a blade unit have become dull from use, the blade unit is discarded, and replaced on the handle with a new blade unit.

Such razors often include a pivoting attachment between the blade unit and an interface element that connects the blade unit to the handle. The blade unit and interface element are typically sold as an assembled unit, referred to herein as a shaving assembly.

In some cases, pivoting is provided by interaction between arms or stanchions that extend from the interface element and mating elements on the blade unit, for example, fingers disposed on the arms that are received by bores in mounting elements extending from the blade unit toward the interface element. Providing proper tolerances to allow the blade unit to be assembled onto the interface element, with the fingers properly inserted in the bores, can prove challenging in a high speed manufacturing setting.

SUMMARY

The present disclosure features shaving razors and shaving assemblies in which features are provided that facilitate assembly of the blade unit onto the interface element, while also, in some implementations, providing advantageous mechanical properties to the arms.

In one aspect, the disclosure features a replaceable shaving assembly that includes a blade unit comprising a plurality of longitudinally extending blades; and an interface element, configured to removeably connect the blade unit to a handle. The blade unit and interface unit include cooperating elements that allow the blade unit to pivot with respect to the interface element, the cooperating elements including a pair of arms extending from the interface unit towards the blade unit. Each of the arms includes a non-elastomeric post, e.g., of a hard thermoplastic, and an elastomeric outer layer in contact with the post.

Some implementations include one or more of the following features. The elastomeric outer layer may completely or partially surround the post. The post has an asymmetric cross-section. Alternatively, the post may have a symmetric cross-section, e.g., circular or square. The elastomeric layer may include a groove. The groove may extend circumferentially around at least a portion of the arm or around the entire arm. The groove may be disposed on an inner surface of each arm, facing the other arm. Alternatively, the groove may be disposed on an outer surface of each arm, facing away from the other arm. In some embodiments, the groove also extends rearwardly around at least a portion of the arm. The post may be tapered along its length, and/or include a notch disposed along its length. The arms may also include structures to facilitate pivoting, for example a finger extending from a distal end of each arm or a shell bearing member extending from a distal end of each arm.

In another aspect, the disclosure features a shaving razor that includes a razor handle having a distal end, and, mounted on the distal end, a shaving assembly that includes a blade unit comprising a plurality of longitudinally extending blades; and an interface element, configured to connect the blade unit to the handle. The blade unit and interface unit include cooperating elements that allow the blade unit to pivot with respect to the interface element, the cooperating elements including a pair of arms extending from the interface unit towards the blade unit. Each arm includes a non-elastomeric post, e.g., of a hard thermoplastic, and an elastomeric outer layer in contact with the post.

This aspect may include any one or more of the features discussed above with regard to the shaving assembly.

DESCRIPTION OF THE DRAWINGS

FIG. 7 is a perspective view of the shaving assembly, FIG. 7C is similar to FIG. 7B but with the elastomeric portion of the arm removed.

DETAILED DESCRIPTION

Figure 1:
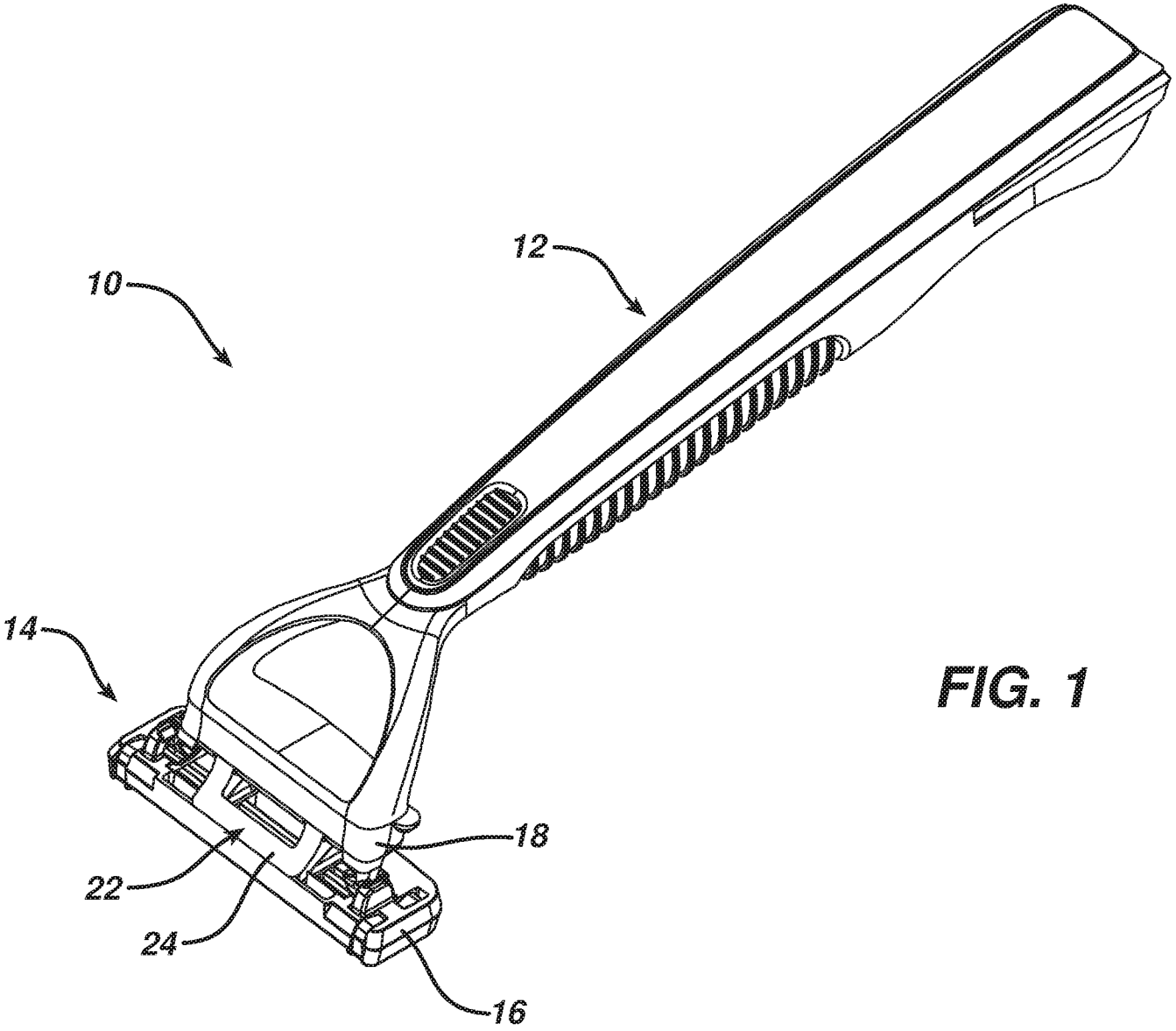
FIG. 1 is a perspective view of a shaving razor.
Figure 1A:
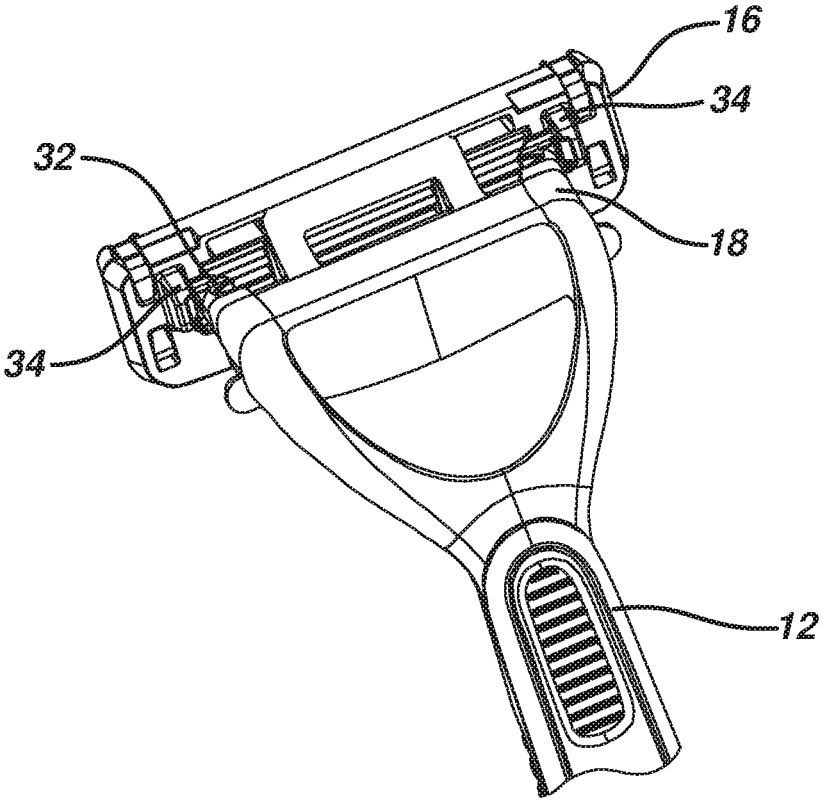
FIG. 1A is an enlarged perspective view of a portion of the razor.
Figure 1B:
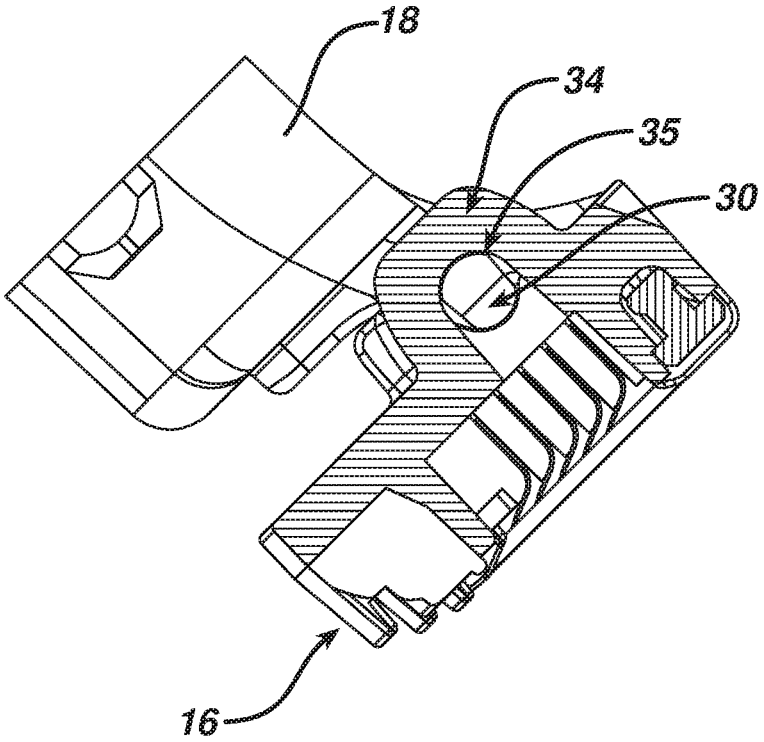
FIG. 1B is a cross-sectional view of the shaving assembly of the razor of FIG. 1.

Referring to FIGS. 1-1B, a razor 10 includes a handle 12 and, mounted at a distal end of the handle, a shaving assembly 14. The shaving assembly 14 includes a blade unit 16 pivotably mounted on an interface element 18. The interface element 18 may be mounted on the handle in any desired manner. In some implementations mounting is accomplished using a magnetic attachment system that includes magnetic and ferrous elements. In some implementations, a magnetic element is associated with an appendage (not shown) at the distal end of the handle and a ferrous element is associated with the receiving portion of the interface element 18, e.g., as disclosed in U.S. Pat. No. 8,789,282, the full disclosure of which is incorporated herein by reference. Generally, the interface element 18 and blade unit are sold to the consumer as an integrated replaceable shaving assembly.

The shaving assembly 14 also includes an elastomeric return element 22, which is similar to the elastomeric return element described in U.S. Pat. No. 9,623,575, the full disclosure of which is incorporated herein by reference. The elastomeric return element includes a central portion 24 that extends generally parallel to the longitudinal axis of the blade unit, and abuts a surface of the blade unit to provide a return force to the blade unit after a shaving stroke. The elastomeric return element 22 extends from the interface element 18 to contact a rear surface of the blade unit 16, and is generally integrally formed with the interface element. For example, the elastomeric return element may be co-molded with or insert molded onto the interface element which is generally formed of a hard thermoplastic.

The blade unit 16 is mounted on interface element 18 by the engagement of a pair of fingers 30 in corresponding bores 35. Fingers 30 are disposed on arms 32 extending from the interface element 18, and are received in bores 35 disposed in mounts 34 (FIG. 1B) extending from the blade unit 16. The mounts 34 are generally molded integrally with the blade unit and the arms 32 are generally molded integrally with the interface element.

The engagement of fingers 30 in bores 35 allows pivoting of the blade unit with respect to the interface unit and thus the handle. Pivoting of the blade unit is about an axis that is generally parallel to the long axis of the blade unit and is generally positioned to allow the blade unit to follow the contours of a user's skin during shaving. This general type of pivoting arrangement is well known in the razor art.

As discussed above, the shaving assembly 14, which consists of the interface element and blade unit, is typically sold to the consumer as an assembled unit. Accordingly, the blade unit is mounted on the interface element during the manufacturing process, which involves bending the arms inward so that the fingers 30 can snap into bores 35.

Figure 2:
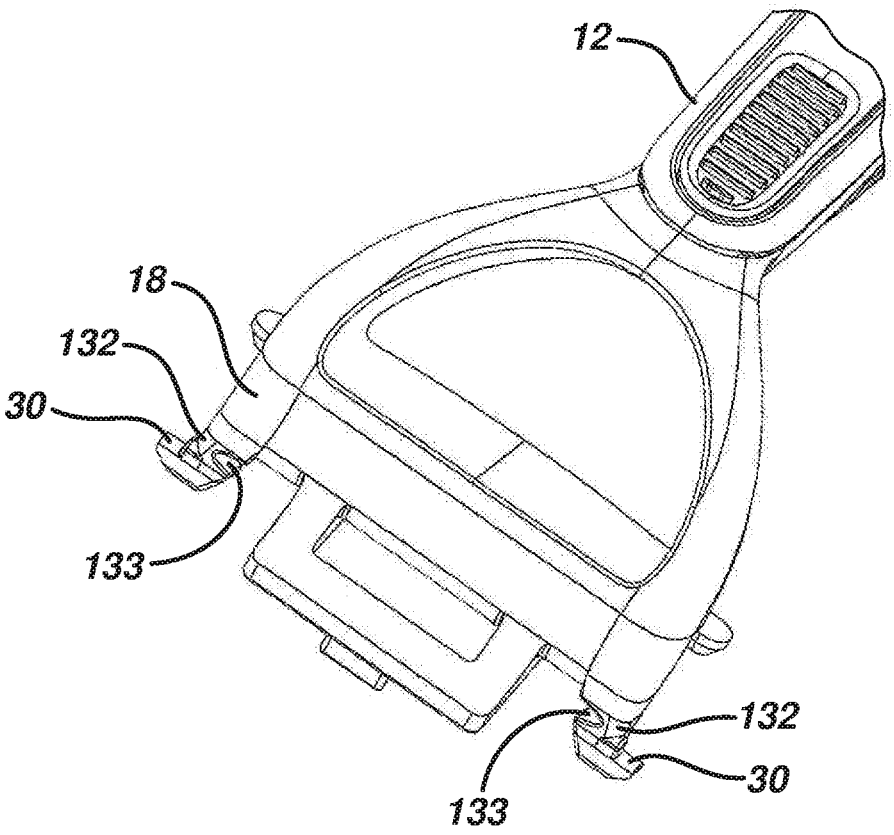
FIG. 2 is an enlarged perspective view of the distal portion of a razor according to one implementation, with the blade unit removed to show certain features more clearly.
Figure 2A:
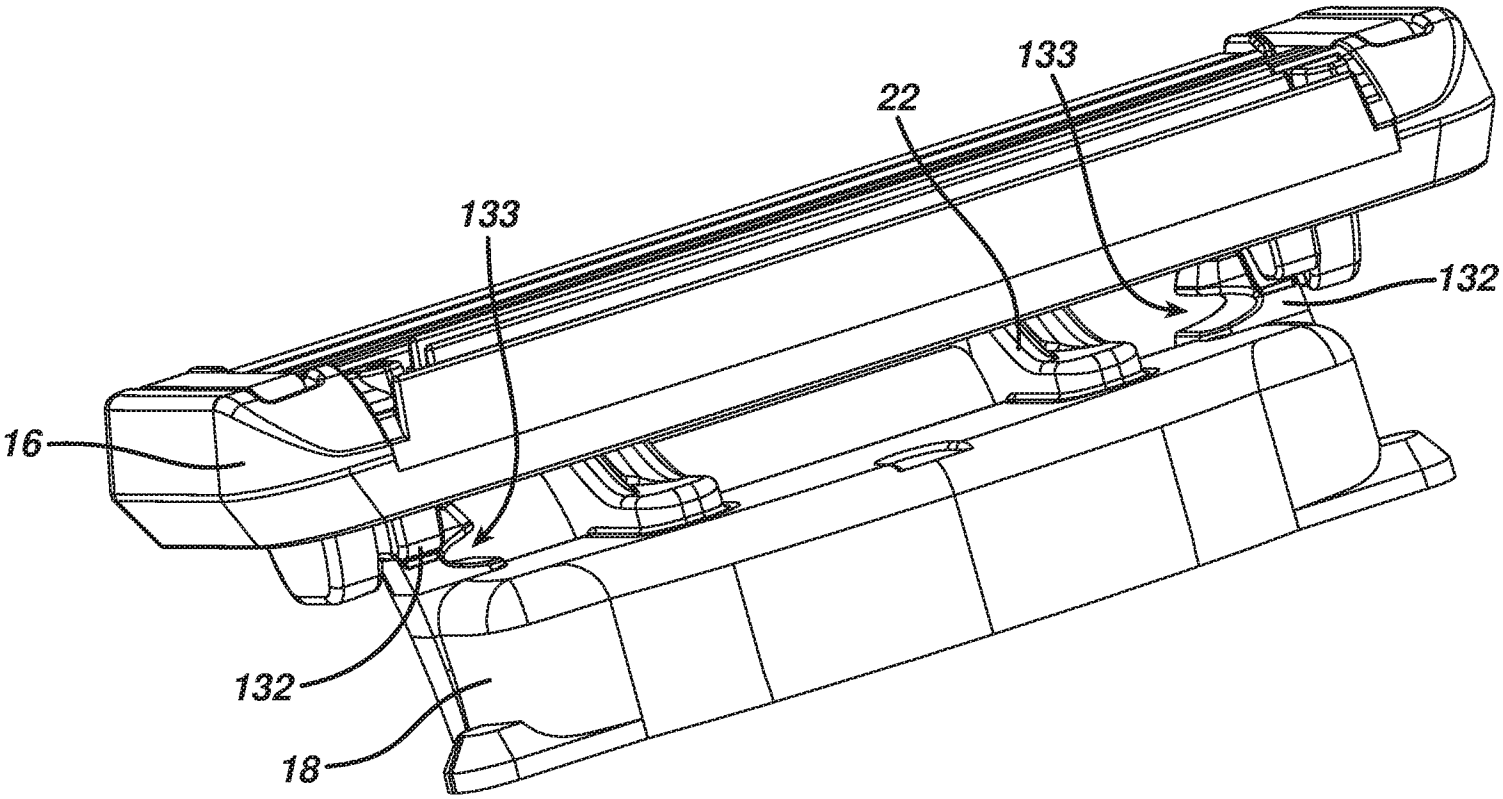
FIG. 2A is a perspective view.
Figure 2B:
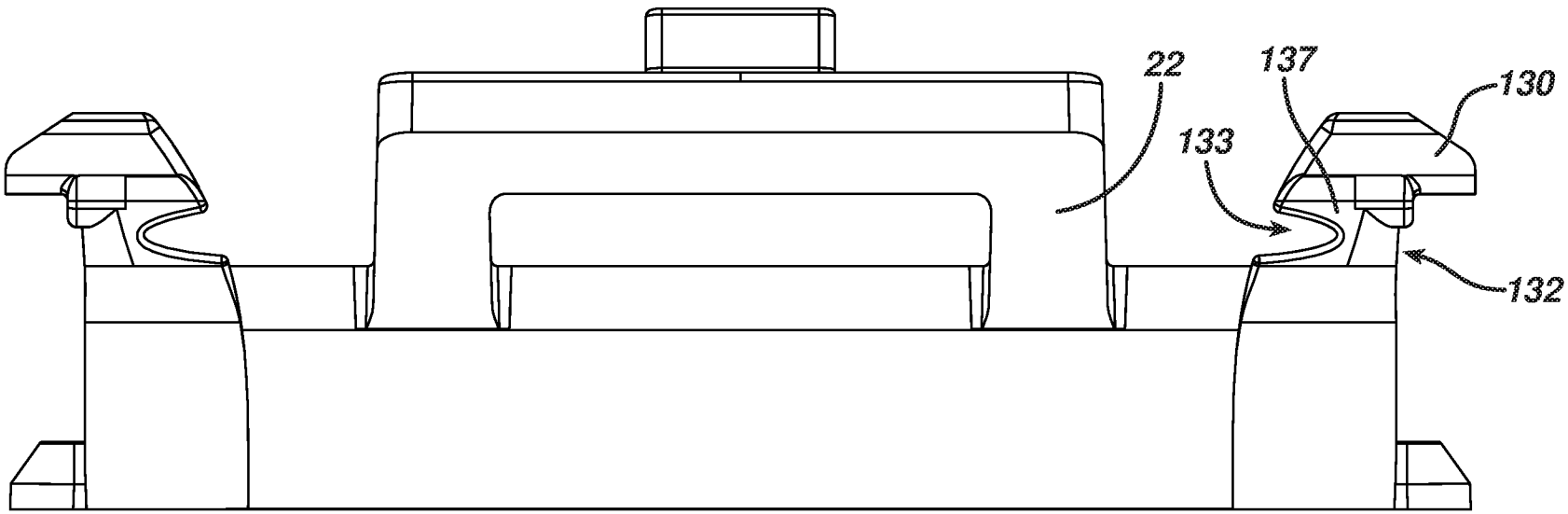
FIG. 2B is a plan view, of the shaving assembly shown in FIG. 2, with the blade unit removed.
Figure 2C:
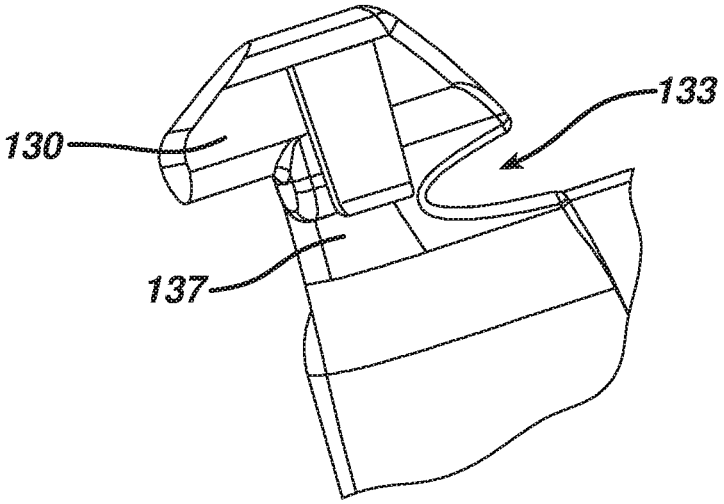
FIG. 2C is an enlarged view of the arm of the interface element.
Figure 2D:
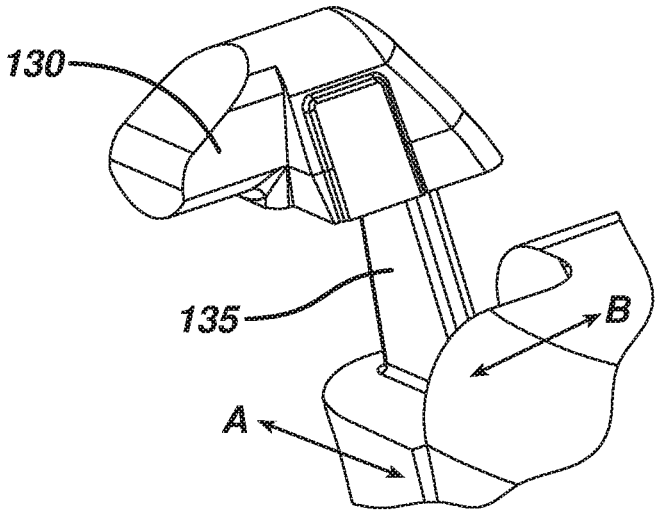
FIG. 2D is a perspective view of the arm of the interface element with the elastomeric material removed.
Figure 2E:
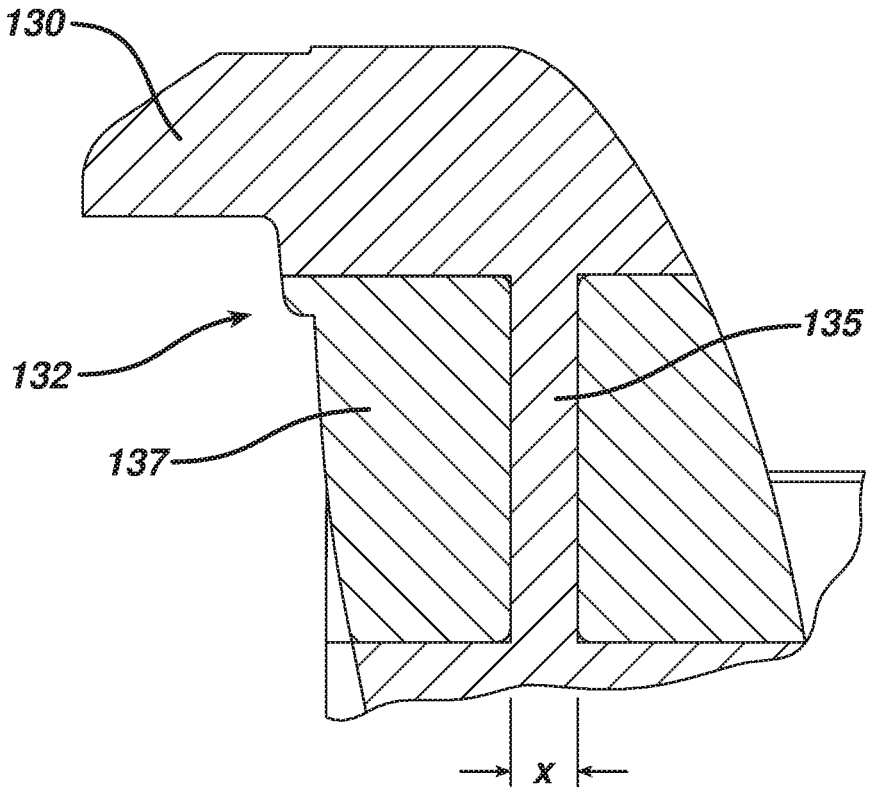
FIG. 2E is a cross-sectional view of the arm.
Figure 2F:
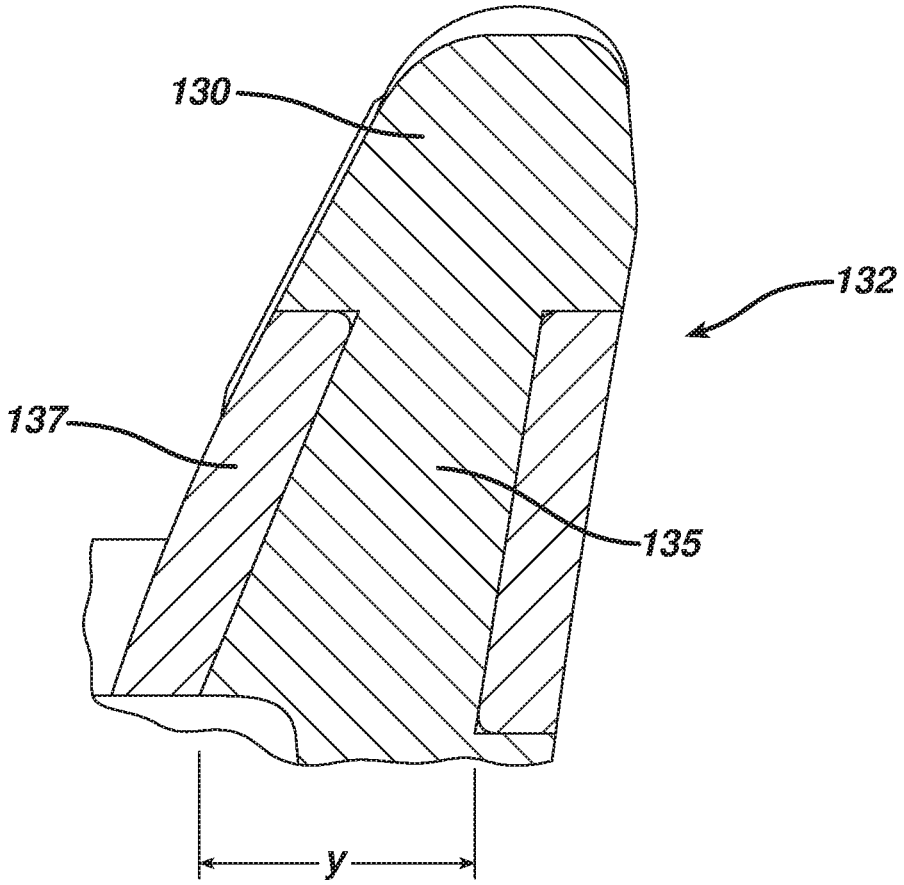
FIG. 2F is a cross-sectional view of the arm taken at 90 degrees to the cross-section shown in FIG. 2E to show the length of the internal post of the arm (the dimension in the direction parallel to the blade unit length.)

In the implementation shown in FIGS. 2-2F, each arm 132 includes a generally rectangular internal post 135 (FIGS. 2D-2F) on which the portion carrying finger 130 is mounted. Post 135 is surrounded by elastomeric material 137 (FIG. 2C), which supports and protects the post 135 during flexing, and provides the arm with desired flexural properties. The elastomeric material surrounding the post may be formed of the same elastomer as the elastomeric return elements, in which case the elastomer typically flows from the same anchor region within the interface element.

The thickness of the elastomeric material is the difference of the thermoplastic post inside and the aesthetic shape of the arms outside. The thickness of the elastomeric material does not need to be uniform, and can be selected so as to provide the arms with an aesthetic shape. The thickness of the post and the presence or absence of any features on the post, such as grooves or notches, has a greater effect on the flexural properties of the arms than the geometry of the thermoplastic layer.

The elastomeric material 137 of each arm includes an internal groove 133, disposed to face towards the opposite arm, that facilitates inward flexure of the arm during assembly. The internal groove 133 is molded into the elastomeric material 137, providing a notch that favors bending of the arm inward, and biases the arm back towards its normal position when the bending force is released. In some implementations, the groove has a depth that is from about 10% to 90% of the elastomer thickness in that region, e.g., from about 40% to 60%.

As can be seen in FIGS. 2E-2F, in this implementation the post 135 is narrow in the direction parallel to the length of the blades, and wider in the direction perpendicular to the length of the blades. For example, the narrow dimension (parallel to the length of the blade unit, as shown in FIG. 2E) could be from about 0.1 to 5.0 mm and the wider dimension (FIG. 2F) may be from about 3 to 25 mm. The width in the direction perpendicular to the blade length stiffens the arms in direction A to help the arms resist shaving forces, while the narrowness in the perpendicular direction allows the arms to flex in direction B to aid assembly of the blade unit onto the interface element to form the shaving assembly.

Thus, the rectangular cross-sectional shape of the post 135 provides the arms with differential flex, i.e., allows the arms to be stiff in a front-to-back direction (arrow A in FIG. 2D) to resist shaving forces, but flexible in a side-to-side direction (arrow B in FIG. 2D) to aid in assembly of the blade unit onto the interface element during manufacturing. The ability of the arms to flex in direction B also allows for less strict tolerance control during manufacturing.

Figure 3:
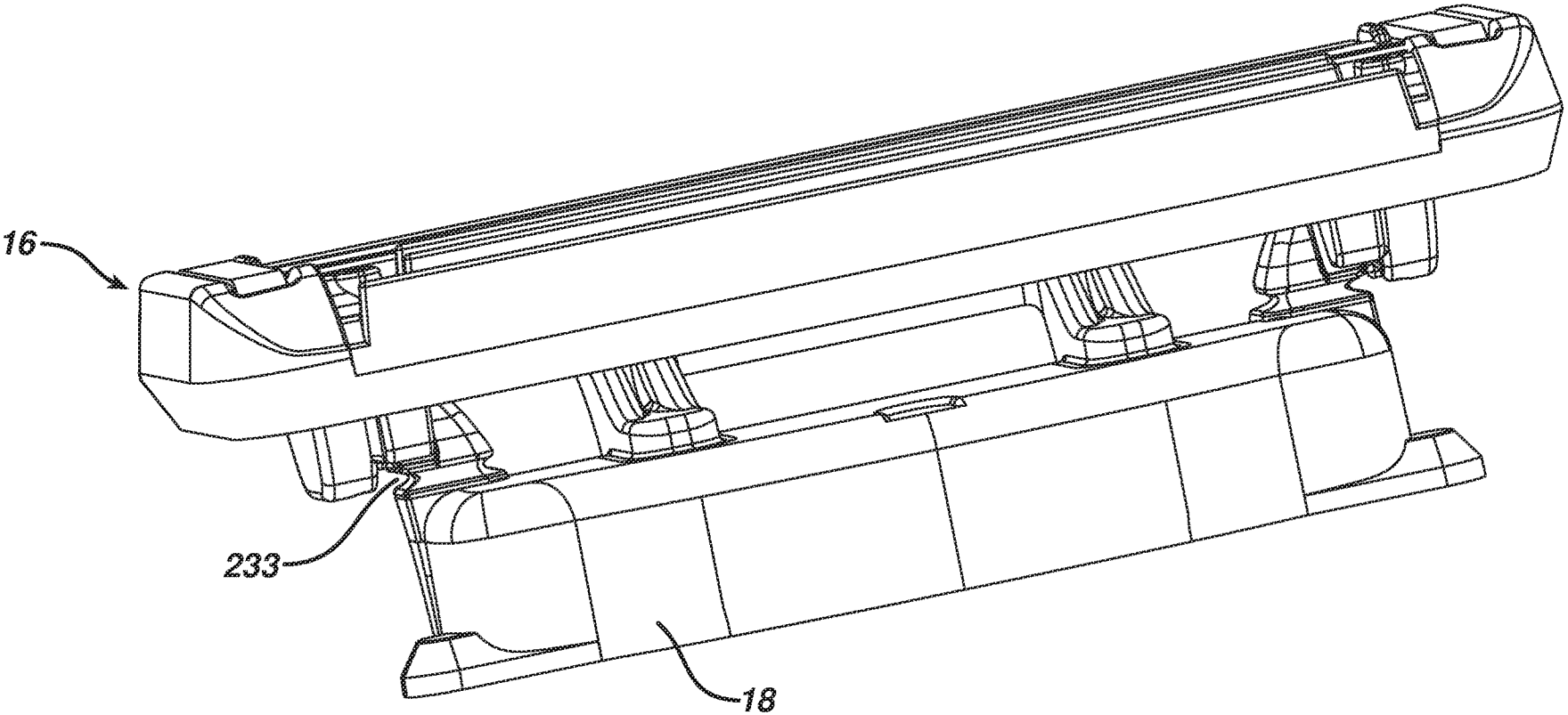
FIG. 3 is a perspective view of a shaving assembly according to an alternate implementation.
Figure 3A:
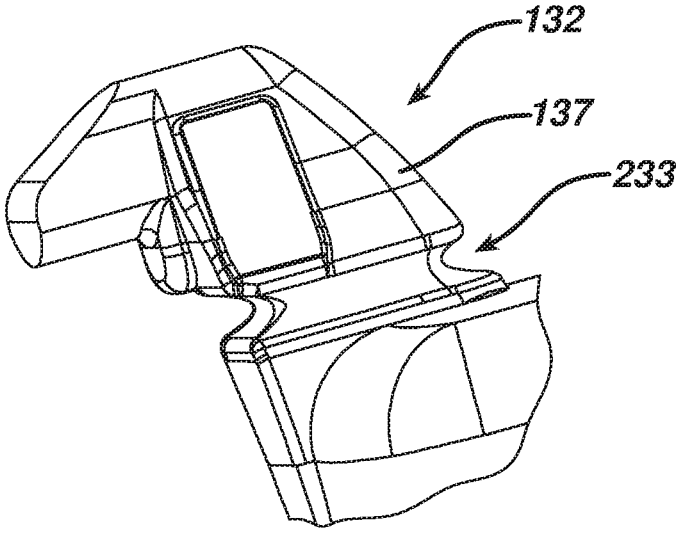
FIG. 3A is an enlarged perspective view of arm of the interface element.
Figure 3B:
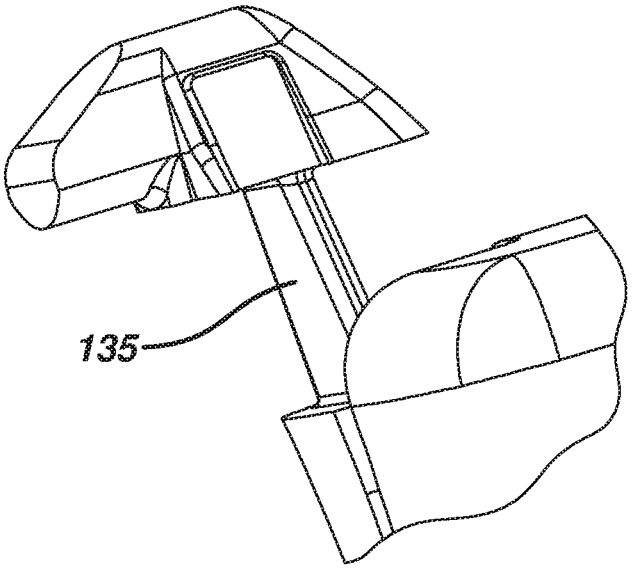
FIG. 3B is an enlarged perspective view of the arm with the elastomeric portion of the arm removed.

FIGS. 3-3B show an alternate implementation, in which the internal groove 133 is replaced by a circumferential groove 233. In this case, the elastomer allows the arms to flex both inwardly and outwardly, but the rectangular cross-section of the post still reduces the forces required in the direction of arrow B in FIG. 2D, while maintaining stiffness in the direction of arrow A. In all other respects, this implementation is similar to that described above with reference to FIGS. 2-2F.

Figure 4:
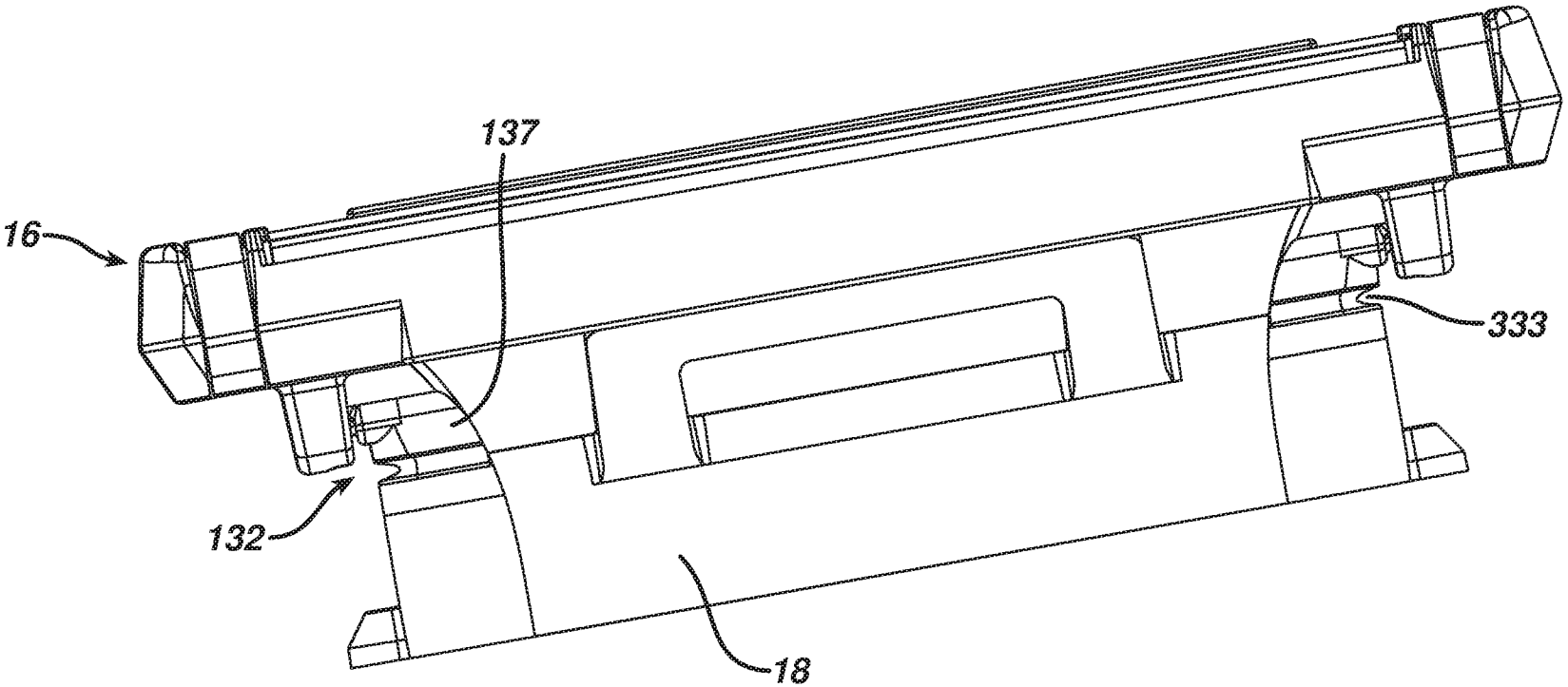
FIG. 4 is a perspective view of a shaving assembly according to another alternate implementation.
Figure 4A:
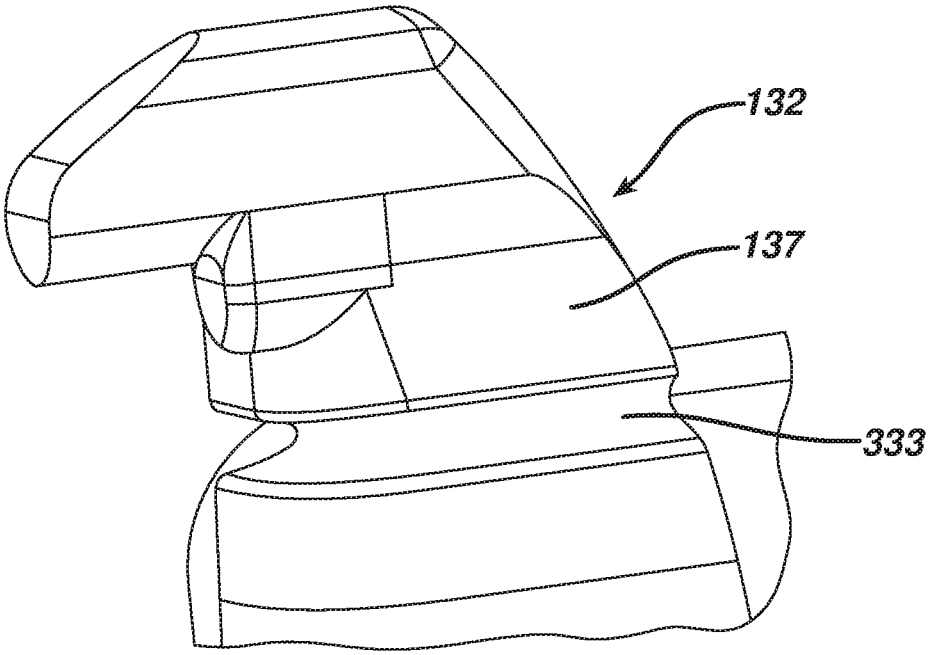
FIG. 4A is an enlarged detail view of the arm of the interface element.
Figure 4B:
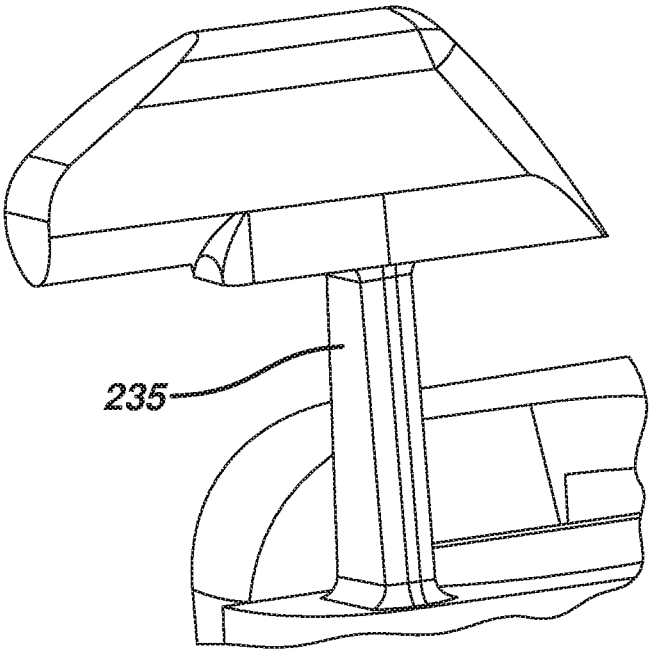
FIG. 4B is similar to FIG. 4A but with the elastomeric portion of the arm removed.

FIGS. 4-4B show another alternate embodiment, in which the elastomeric material includes a partial circumferential groove 333, extending around the rear of the arms (i.e., the side of the arm furthest from the guard 11 of the blade unit.) As shown in FIG. 4B, the post 235 is generally rectangular in cross-section. (Other shapes can be used that are deeper in the direction of arrow A than in the direction of arrow B, e.g., elliptical or egg-shaped.) As a result, the post shape provides differential flex properties similar to those described above with reference to FIGS. 2-2E, while the partial circumferential groove in the elastomer positioned on the outside and rearward portions of the groove allow sufficient flex during assembly and some flex in the shaving direction to provide cushioning of shaving forces.

Figure 5:
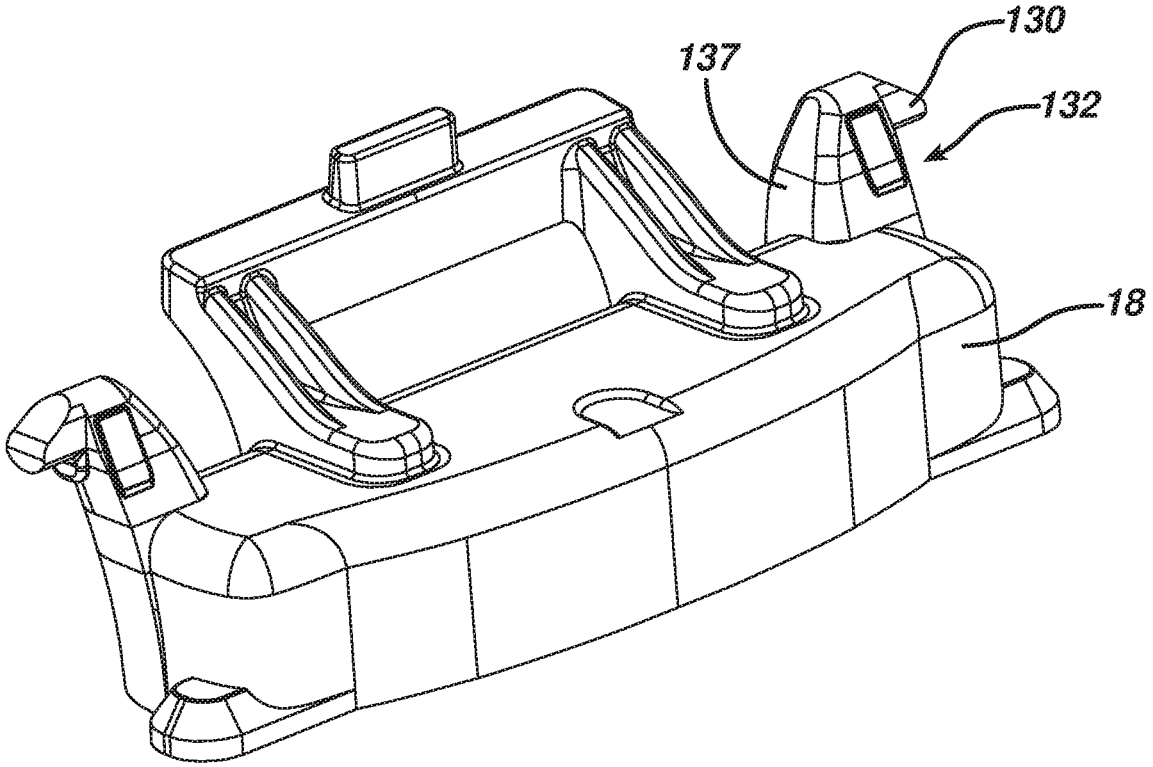
FIG. 5 is a perspective view of an interface element according to yet another alternate implementation.
Figure 5A:
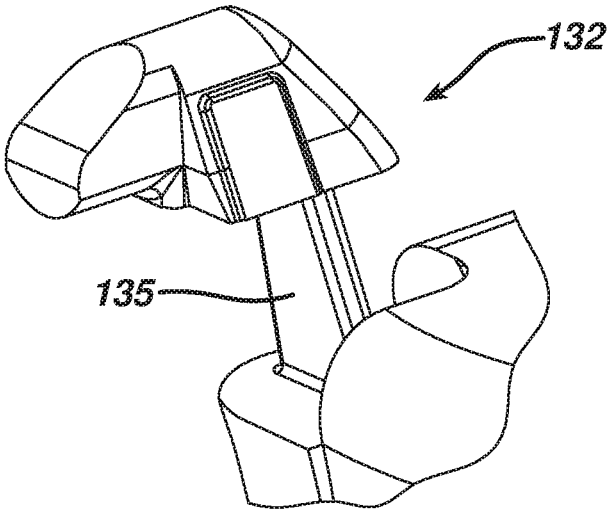
FIG. 5A is an enlarged detail view of the arm of the interface element with the elastomeric portion of the arm removed.

FIGS. 5-5A show a further alternate embodiment, in which the arms do not have any groove in the elastomeric material. This embodiment simplifies manufacturing and provides the shaving assembly with a clean look from an aesthetic perspective.

Figure 6:
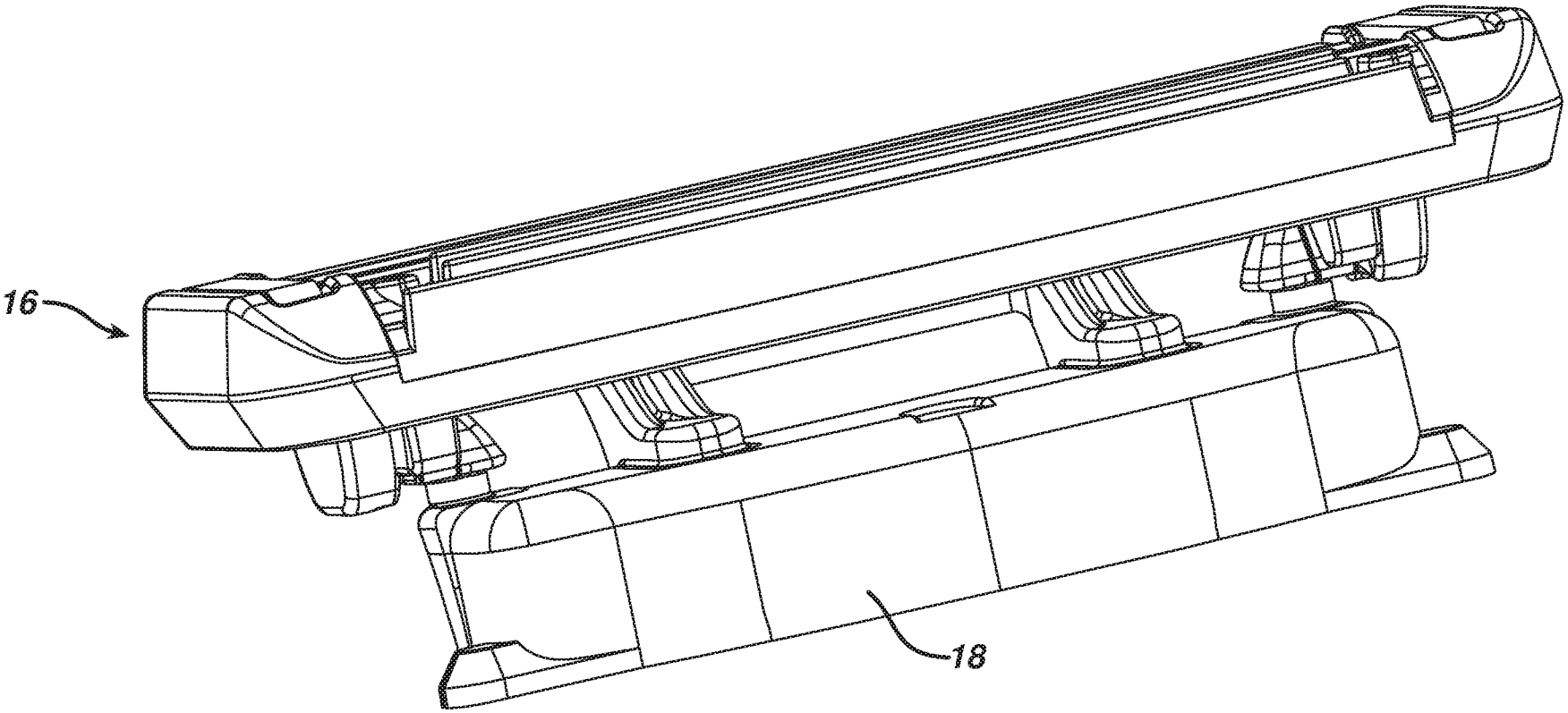
FIG. 6 is a perspective view of a shaving assembly according to an alternate implementation in which the arms of the interface element do not exhibit differential flexing.
Figure 6A:
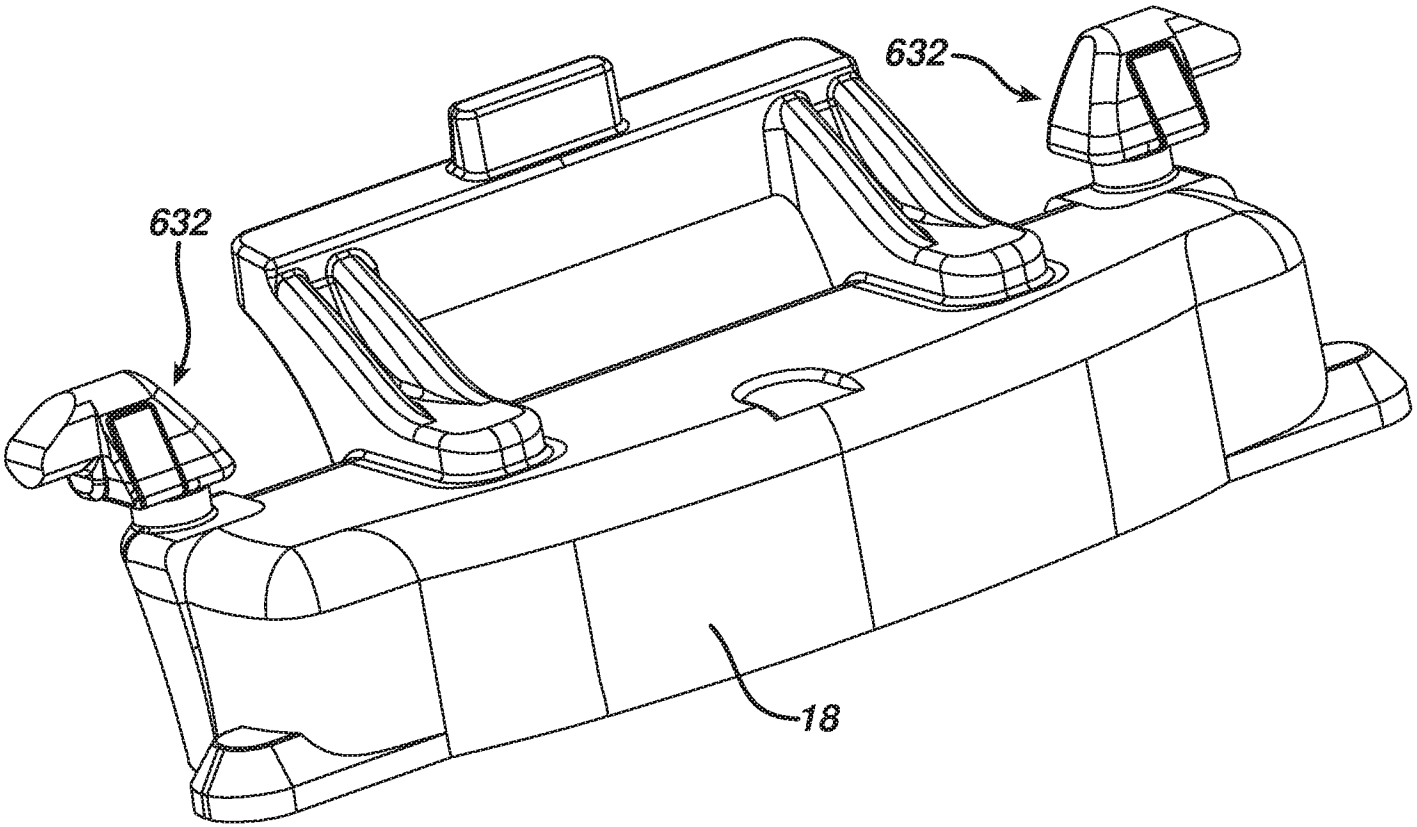
FIG. 6A is a perspective view of the interface element of the shaving assembly.
Figure 6B:
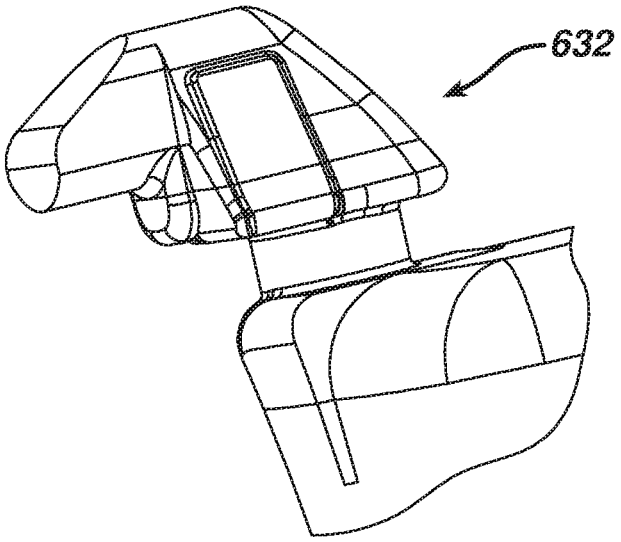
FIG. 6B is an enlarged detail view of the circled area in FIG. 6A.
Figure 6C:
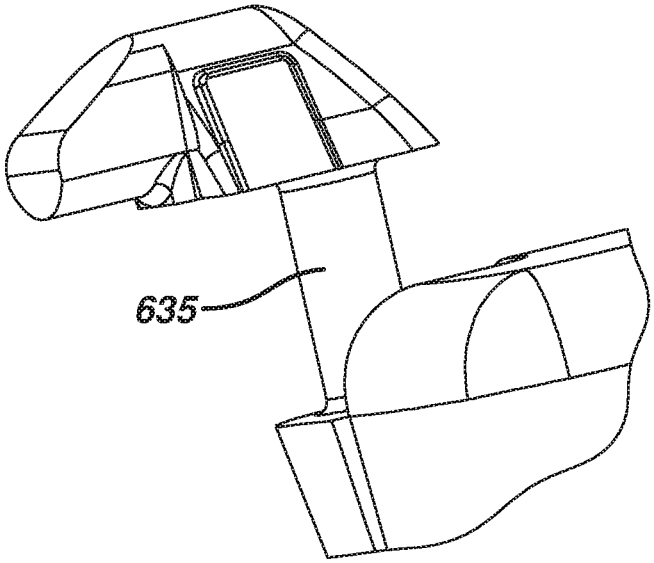
FIG. 6C is similar to FIG. 6B but with the elastomeric portion of the arm removed.

Referring to FIGS. 6-6C, in another implementation the arms 632 include posts 635 that are cylindrical (has a circular cross-section), rather than having a rectangular cross-section. Because the post has a symmetrical cross-section the flex is not differential, but rather is the same regardless of the direction of applied force.

Figure 7:
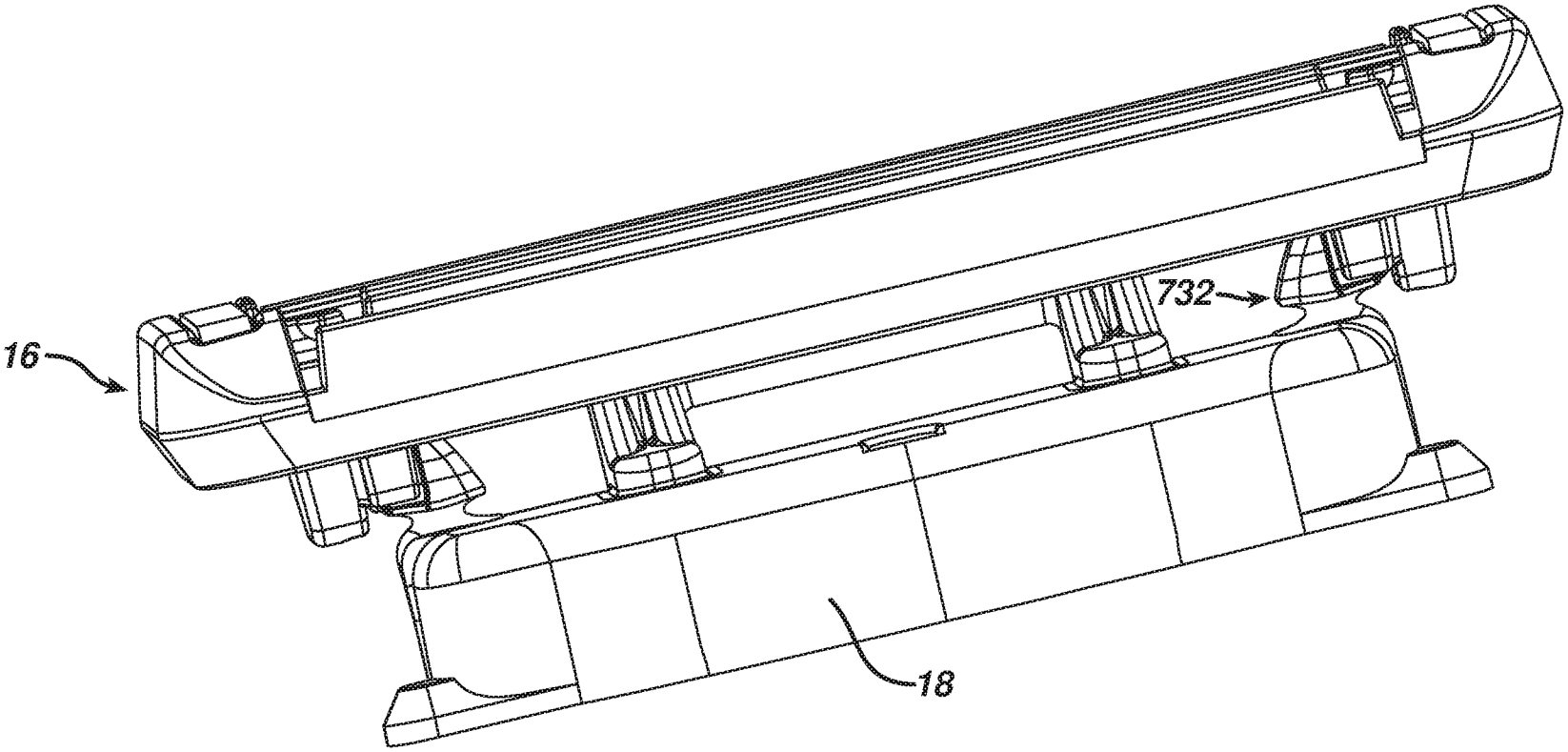
FIGS. 7-7C show another alternate embodiment in which the arms of the interface element do not exhibit differential flexing.
Figure 7A:
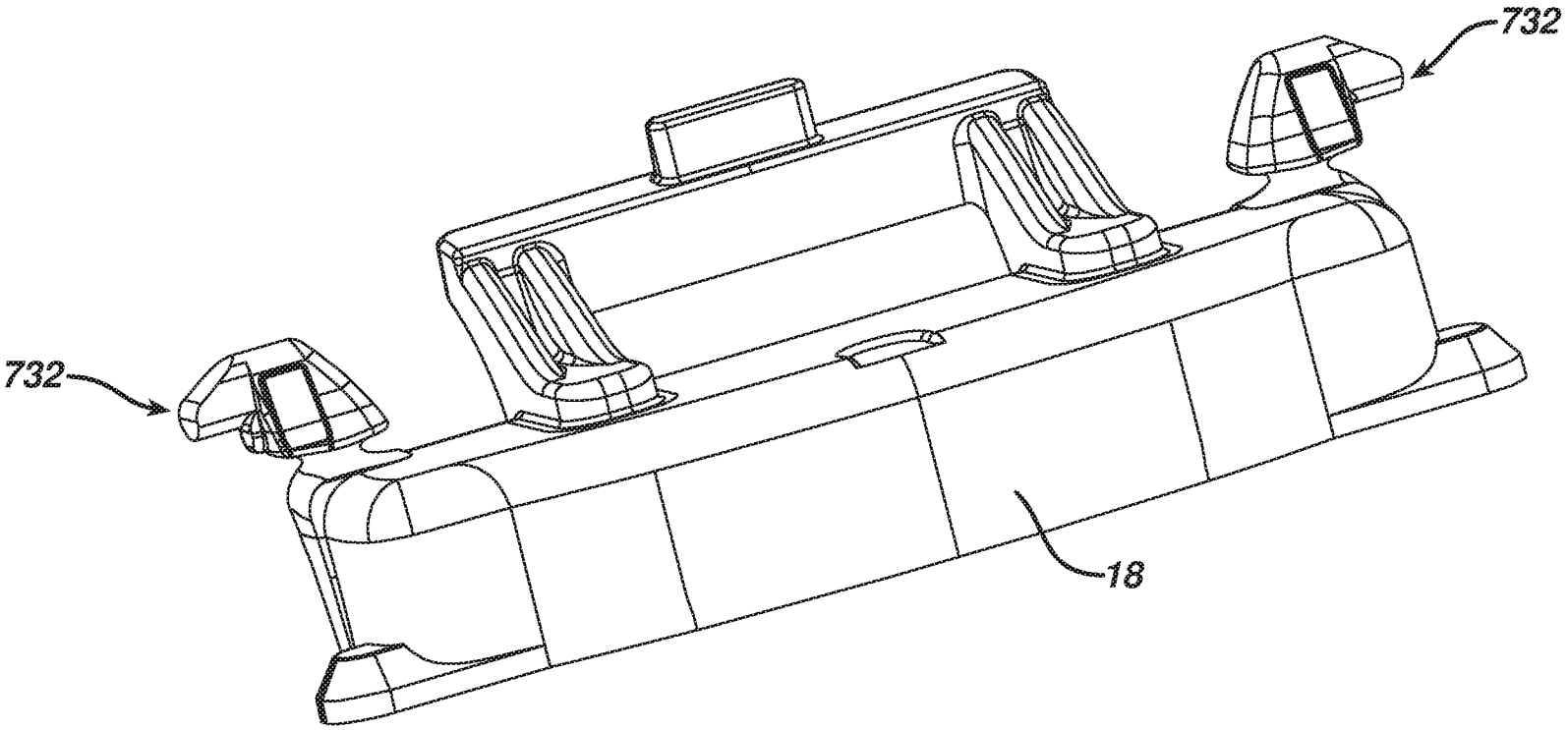
FIG. 7A is a perspective view of the interface element.
Figure 7B:
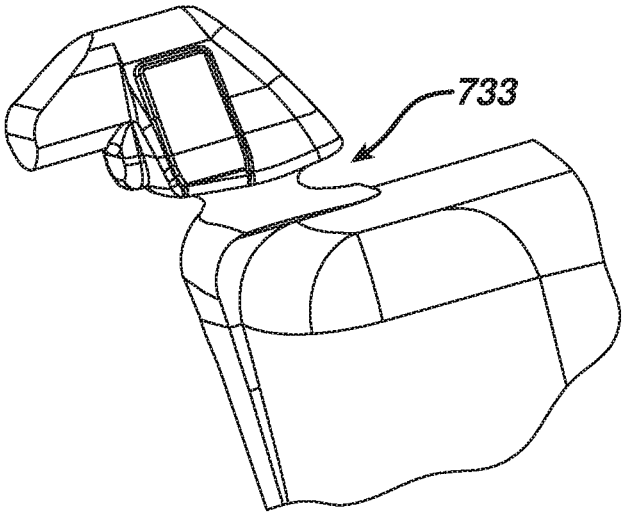
FIG. 7B is an enlarged detail view of the arm.
Figure 7C:
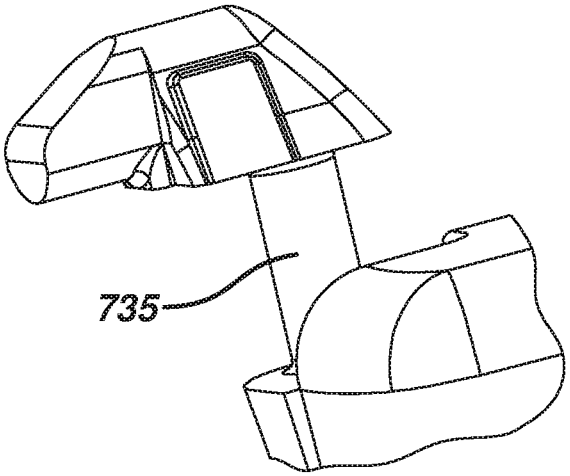

In the embodiment shown in FIGS. 7-7C, a cylindrical post 735 is used with a circumferential groove 733, combining the features of the embodiments shown in FIGS. 3-3B and FIGS. 6-6C. In this embodiment, as in the embodiment shown in FIGS. 6-6C, flex is not differential, but will be in the direction of applied force.

While pivoting is provided by a finger/bore arrangement in the embodiments discussed above, other pivoting arrangements can be used. For example, pivoting can be provided by a pair of shell bearing units, as is the case in the implementation shown in FIGS. 8-9A. Such shell bearing pivoting arrangements are disclosed in U.S. Patent Application No. 62/534,995, the full disclosure of which is incorporated herein by reference.

Figure 8:
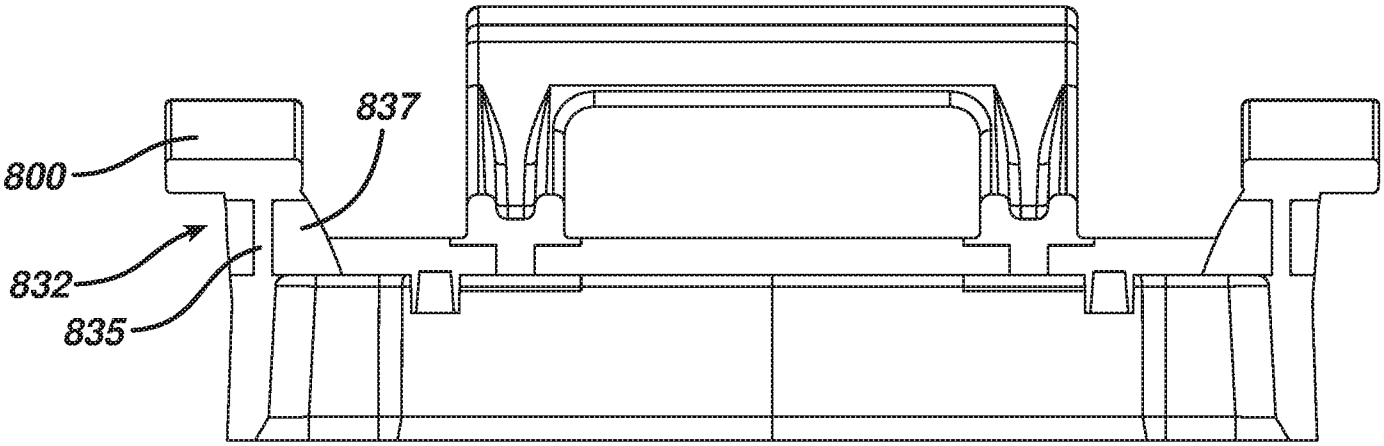
FIG. 8 is a plan view of an interface element with a shell bearing pivoting arrangement.
Figure 8A:
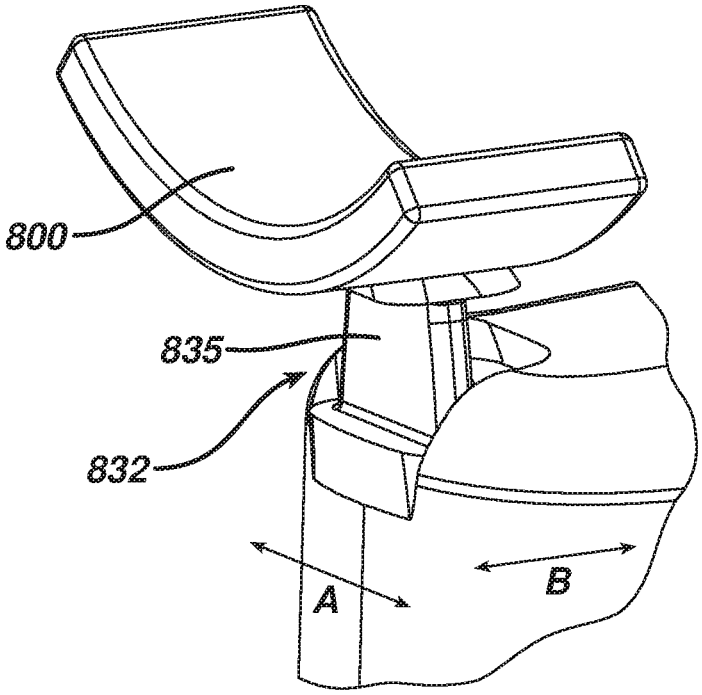
FIG. 8A is an enlarged detail perspective view of an arm of the interface element with the elastomeric portion of the arm removed.
Figure 9:
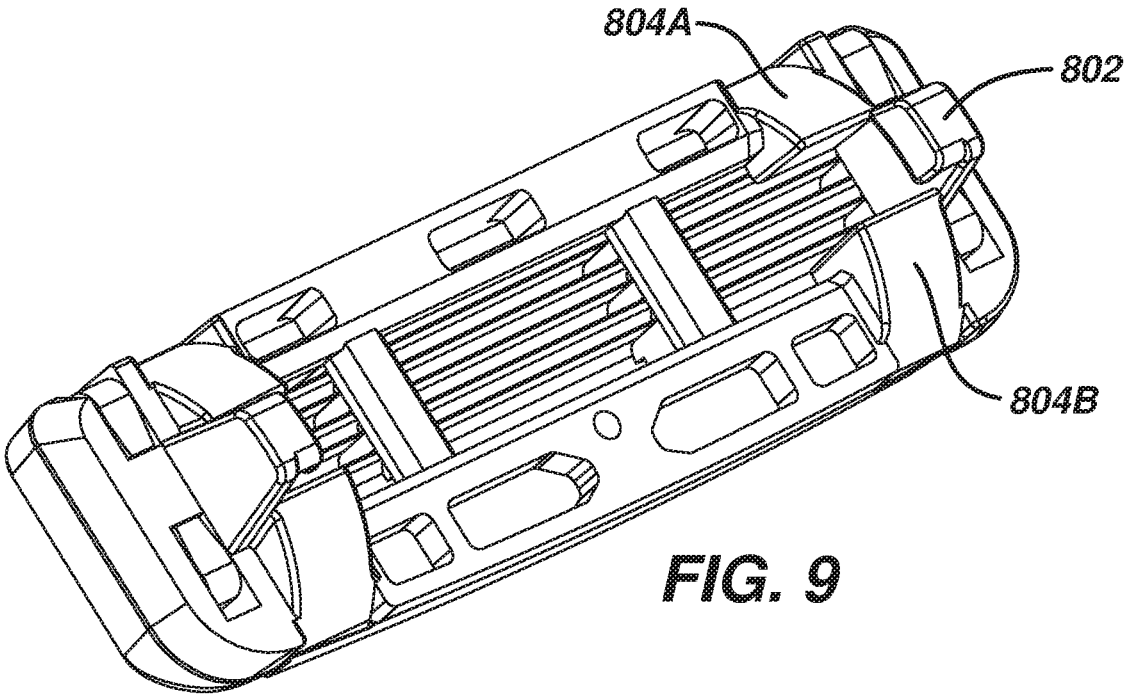
FIG. 9 is a perspective view of a blade assembly used with the interface element shown in FIG. 8.
Figure 9A:
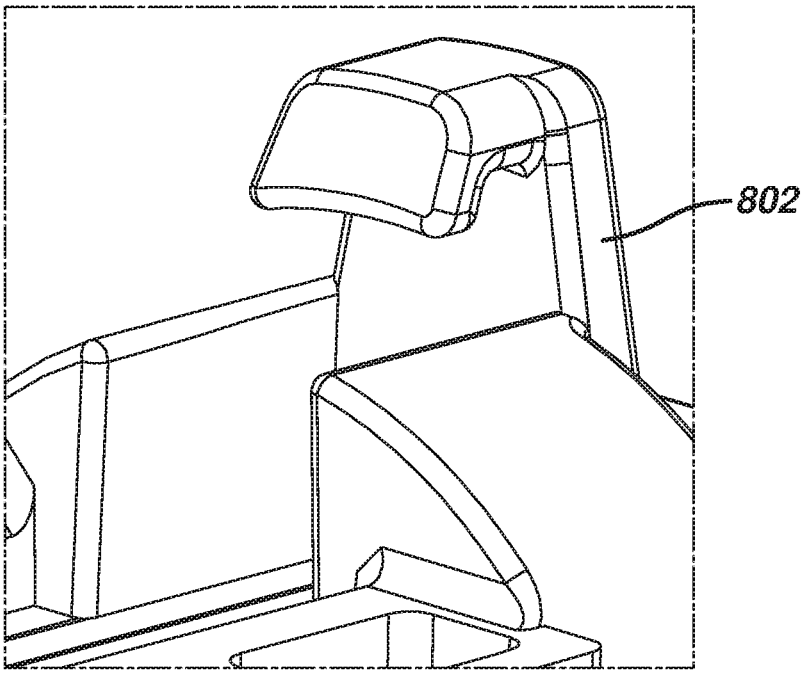
FIG. 9A is an enlarged detail view of a portion of the blade assembly that interacts with the arm shown in FIG. 8A.

Referring to FIGS. 8 and 8A, in this implementation a shell bearing element 800 is disposed at a distal end of arm 832, which includes post 835 encapsulated in elastomer 837. The elastomeric material is removed for clarity in FIG. 8A, but surrounds the post 835 as in the implementations described above.

When the shaving assembly is assembled, the shell bearing element 800 interacts with hooked stanchion 802 and shell bearing elements 804A and 804B as described in the application incorporated by reference above. During assembly, it is necessary for the arms 832 to flex inward (direction B in FIG. 8A) in order to clear stanchion 802, while during shaving it is generally preferred that the arms be relatively stiff in the direction of shaving forces (direction A in FIG. 8A). These competing requirements are accommodated by the differential flex of the arms provided by the rectangular cross-section posts, as discussed above.

Another type of shaving assembly in which the arms described herein can be useful is disclosed in U.S. Pat. No. 9,283,685, the complete disclosure of which is incorporated by reference herein. In some embodiments of this type of shaving assembly, the fingers extending from the arms are received in elastomeric loops that extend integrally from the guard of the blade unit. Use of flexible arms in such an arrangement can facilitate assembly, provide a better fit between the fingers and loops, and accommodate tolerance variations.

In all of the embodiments discussed above the elastomeric portion of the arm can be formed, for example, from synthetic or natural rubber materials. Suitable materials include thermoplastic elastomers, for example, polyether-based thermoplastic elastomers (TPEs) available from Kraiburg HTP, thermoplastic urethanes (TPUs), silicones, polyether-based thermoplastic vulcanizate elastomer (TPVs) available from Exxon Mobil Corporation under the tradename Santoprene™. The elastomeric material is selected to provide a desired degree of restoring force and durability. In some implementations, the elastomer has a Durometer of less than about 45 Shore A, e.g., from about 20 to 90 Shore A.

In some implementations, the return element is formed of the same elastomeric material, to facilitate molding. In this case, the material for the elastomeric portions of the arms and the return element may be molded in a single shot such that the elastomeric portions and return element share a common anchor in the interface element.

Alternatively, if it is desired that the elastomeric portions have different characteristics from the return element they may be formed of different materials.

The return elements are generally designed such that their geometry provides an applied load as assembled that is sufficient to return the blade unit to its rest position when not in use, for example, when the handle is being held without any load on the blade unit. Preferably the pretensioned load is typically at least 5 grams, e.g., 5 to 50 grams, and the load during shaving is from about 5 to 100 grams.

The housing of the blade unit and the interface element can be made of any suitable hard material including, for example, acetal (POM), acrylonitrile butadiene styrene (ABS), polyethylene terephthalate (PET or PETE), high density (HD) PETE, high impact polystyrene (HIPS), thermoplastic polymer, polypropylene, oriented polypropylene, polyurethane, polyvinyl chloride (PVC), polytetrafluoroethylene (PTFE), polyester, high-gloss polyester, nylon, or any combination thereof.

Other embodiments are within the scope of the following claims.

For example, while rectangular and cylindrical posts have been discussed above, the post may have any desired assymetrical shape (e.g., elliptical) for differential flex, or any desired symmetrical shape (e.g., regular polygonal such as square) for uniform flex.

Figure 10:
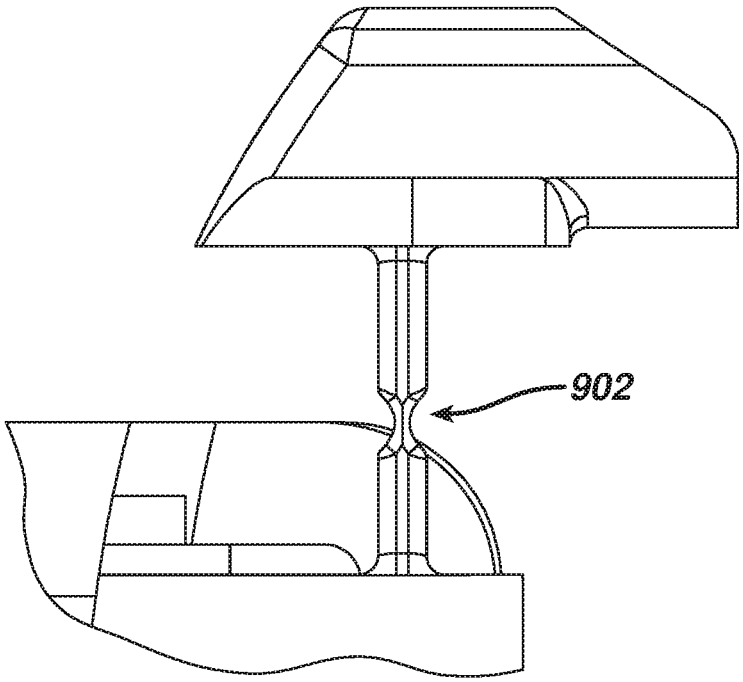
FIG. 10 shows a post according to an alternative embodiment.

Moreover, while posts having a uniform cross-section have been shown, the post can taper along its length if desired, or can include discontinuities along its length. For example, as shown in FIG. 10 the post can have a necked-in region 902 that has a very thin cross-section. The region 902 is weak relative to the rest of the length of the post, and can be designed to snap when the arms are flexed during assembly of the blade unit onto the interface element. Once the region 902 has snapped, the flexure of the arms will be dictated entirely by the flexural characteristics of the surrounding elastomer (not shown). This embodiment can allow the arms to have very different flexural characteristics pre-assembly and post-assembly, for example to provide greater compliance during shaving.

In addition, while the elastomeric material is shown as surrounding the post, the elastomeric material can in some embodiments extend only partially around the post, e.g., in only an area that needs to be resiliently supported. The flexural properties of the arm are generally provided primarily by the post, so the design of the elastomeric layer can be dictated at least in part by aesthetics.

What is claimed is:

1. A shaving razor comprising:

a razor handle having a distal end, and mounted on the distal end, a shaving assembly comprising:

a blade unit comprising a plurality of longitudinally extending blades; and an interface element, configured to connect the blade unit to the handle;

wherein the blade unit and the interface element include cooperating elements that allow the blade unit to pivot with respect to the interface element, the cooperating elements including a pair of arms extending from the interface element towards the blade unit; and wherein each of the arms includes a non-elastomeric post and an elastomeric outer layer in contact with the post, the elastomeric layer having a groove disposed on an inner surface of each arm, facing the other arm.

2. The razor of claim 1, wherein the interface element is configured to removably connect the blade unit to the handle.

3. The razor of claim 1 wherein the elastomeric outer layer surrounds the post.

4. The razor of claim 1 wherein the post has an asymmetric cross-section.

5. The razor of claim 1 wherein the post has a symmetric cross-section.

6. The razor of claim 5 wherein the cross-section is circular.

7. The razor of claim 1 wherein the groove extends circumferentially around at least a portion of the arm.

8. The razor of claim 1 wherein the post includes a notch disposed along its length.

9. The razor of claim 1 wherein each arm further includes a finger extending from a distal end of the arm.

10. The razor of claim 1 wherein each arm further includes a shell bearing member extending from a distal end of the arm.

11. A replaceable shaving assembly comprising:

a blade unit comprising a plurality of longitudinally extending blades; and an interface element, configured to removeably connect the blade unit to a handle;

wherein the blade unit and the interface element include cooperating elements that allow the blade unit to pivot with respect to the interface element, the cooperating elements including a pair of arms extending from the interface element towards the blade unit; and wherein each of the arms includes a non-elastomeric post and an elastomeric outer layer in contact with the post, the elastomeric layer having a groove disposed on an inner surface of each arm, facing the other arm.

12. The shaving assembly of claim 11 wherein the elastomeric outer layer surrounds the post.

13. The shaving assembly of claim 11 wherein the post has an asymmetric cross-section.

14. The shaving assembly of claim 11 wherein the post has a symmetric cross-section.

15. The shaving assembly of claim 14 wherein the cross-section is circular.

16. The shaving assembly of claim 11 wherein the groove extends circumferentially around at least a portion of the arm.

17. The shaving assembly of claim 11 wherein the post includes a notch disposed along its length.

18. The shaving assembly of claim 11 wherein each arm further includes a finger extending from a distal end of the arm.

19. The shaving assembly of claim 11 wherein each arm further includes a shell bearing member extending from a distal end of the arm.

20. A replaceable shaving assembly comprising:

a blade unit comprising a plurality of longitudinally extending blades; and an interface element, configured to removeably connect the blade unit to a handle;

wherein the blade unit and the interface element include cooperating elements that allow the blade unit to pivot with respect to the interface element, the cooperating elements including a pair of arms extending from the interface element towards the blade unit; and wherein each of the arms includes a non-elastomeric post and an elastomeric outer layer in contact with the post, the elastomeric layer having a groove disposed on an outer surface of each arm, facing away from the other arm.

21. The shaving assembly of claim 20 wherein the elastomeric outer layer surrounds the post.

22. The shaving assembly of claim 20 wherein the post has an asymmetric cross-section.

23. The shaving assembly of claim 20 wherein the post has a symmetric cross-section.

24. The shaving assembly of claim 23 wherein the cross-section is circular.

25. The shaving assembly of claim 20 wherein the post includes a notch disposed along its length.

26. The shaving assembly of claim 20 wherein each arm further includes a finger extending from a distal end of the arm.

27. The shaving assembly of claim 20 wherein each arm further includes a shell bearing member extending from a distal end of the arm.

28. A shaving razor comprising: a razor handle having a distal end, and mounted on the distal end, a shaving assembly comprising: a blade unit comprising a plurality of longitudinally extending blades; and an interface element, configured to connect the blade unit to the handle; wherein the blade unit and the interface element include cooperating elements that allow the blade unit to pivot with respect to the interface element, the cooperating elements including a pair of arms extending from the interface element towards the blade unit; and wherein each of the arms includes a non-elastomeric post and an elastomeric outer layer in contact with the post, the elastomeric layer having a groove disposed on an outer surface of each arm, facing away from the other arm.

* * * * *